US011034554B2

(12) United States Patent
Larmonier

(10) Patent No.: US 11,034,554 B2
(45) Date of Patent: Jun. 15, 2021

(54) METHOD FOR SECURING A LUFFING JIB CRANE AND A CRANE ASSOCIATED THERETO

(71) Applicant: Manitowoc Crane Group France, Dardilly (FR)

(72) Inventor: Nicolas Larmonier, Lyons (FR)

(73) Assignee: MANITOWOC CRANE GROUP FRANCE, Dardilly (FR)

( * ) Notice: Subject to any disclaimer, the term of this patent is extended or adjusted under 35 U.S.C. 154(b) by 432 days.

(21) Appl. No.: 16/137,999

(22) Filed: Sep. 21, 2018

(65) Prior Publication Data

US 2019/0092606 A1 Mar. 28, 2019

(30) Foreign Application Priority Data

Sep. 28, 2017 (FR) ..... 17/59018

(51) Int. Cl.

| | |
|---|---|
| ***B66C 13/18*** | (2006.01) |
| ***B66C 23/00*** | (2006.01) |
| ***B66C 15/00*** | (2006.01) |
| ***B66C 23/88*** | (2006.01) |
| ***B66C 23/82*** | (2006.01) |
| *B66C 23/16* | (2006.01) |

(52) U.S. Cl.

CPC ..... *B66C 13/18* (2013.01); *B66C 15/00* (2013.01); *B66C 23/82* (2013.01); *B66C 23/88* (2013.01); *B66C 23/16* (2013.01)

(58) Field of Classification Search

None

See application file for complete search history.

(56) References Cited

U.S. PATENT DOCUMENTS

| | | | | |
|---|---|---|---|---|
| 5,282,136 | A * | 1/1994 | Zui | B66C 13/20 701/50 |
| 2005/0192732 | A1* | 9/2005 | Narisawa | B66C 23/905 701/50 |
| 2009/0008351 | A1* | 1/2009 | Schneider | B66C 13/46 212/272 |
| 2012/0271582 | A1* | 10/2012 | Bageshwar | G01R 33/0035 702/92 |
| 2013/0062301 | A1* | 3/2013 | Wagner | B66C 23/88 212/276 |

FOREIGN PATENT DOCUMENTS

| | | | |
|---|---|---|---|
| DE | 102010008155 | A1 | 8/2011 |
| FR | 2641773 | A1 | 7/1990 |
| FR | 2892405 | A1 | 4/2007 |

* cited by examiner

*Primary Examiner* — Todd Melton
*Assistant Examiner* — Jason R Roberson
(74) *Attorney, Agent, or Firm* — Klintworth & Rozenblat IP LLP

(57) ABSTRACT

A method for securing a luffing jib crane includes: acquiring a lifting/lowering setpoint; piloting a lifting motor by a converter that applies a motor command speed as a function of the setpoint; driving, in lifting or in lowering, the jib by a lifting cable under the action of the lifting motor; calculating, by a control/command system, a lifting/lowering theoretical angular speed from the motor command speed or from the setpoint; calculating, by the control/command system, a lifting/lowering actual angular speed from a jib angle measured by an angle sensor; comparing the actual angular speed and the theoretical angular speed; and commanding the stopping of the lifting motor according to the result of the comparison.

9 Claims, 2 Drawing Sheets

METHOD FOR SECURING A LUFFING JIB CRANE AND A CRANE ASSOCIATED THERETO

CROSS-REFERENCE TO RELATED APPLICATION

This application claims priority under 35 U.S.C. § 119(a) to French Patent Application No. 17/59018, filed on Sep. 28, 2017, the disclosure of which is incorporated by reference herein in its entirety.

FIELD

The present invention relates to a method for securing a luffing jib crane, and especially a luffing jib tower crane, as well as a luffing jib crane adapted for such a securing method. The present invention further relates to luffing jib cranes equipped with a lifting winch incorporating a lifting motor coupled to at least one lifting cable for the driving of the lifting or lowering jib.

BACKGROUND

Examples of luffing jib cranes equipped with a lifting winch incorporating a lifting motor coupled to at least one lifting cable for the driving of a lifting or lowering jib are described in French patent publications FR2641773 and FR2892405, the disclosures of which are incorporated herein by reference, in their entireties.

In a conventional luffing jib crane, an unintended event, such as a failure at the lifting winch, an unfavorable weather condition, a collision or a false maneuver may lead to conditions where:

- during a lowering of the jib, the jib remains temporarily blocked or sufficiently slowed in its lowering so that the lifting cable loosens until generating a possibility of more or less sudden adjustment of the cable slack;
- during a lifting of the jib, the jib is accelerated in its lifting (especially under the pulse of a wind that pushes the jib upwards) so that the lifting cable loosens until generating also a possibility of more or less sudden adjustment of the cable slack.

According to the magnitude of this adjustment, the jib can potentially tilt with enough force to damage the crane or the lifting cable. In other words, such inadvertent displacements may constitute unwanted movements of the jib, sources of dynamic jolts or abrupt breaks in the movement, in lifting or in lowering, of the jib.

Currently, only a manual intervention by the crane driver can stop the movement of the jib and thus prevent slack in the lifting cable, which requires continuous attention from the driver when driving the tower crane in its lifting and lowering phases.

SUMMARY

The invention proposes to provide a solution for securing a jib crane which is automated and which is configured to stop the lifting or lowering movement when the actual speed of the jib deviates from the speed desired by the driver.

To this end, it proposes a method for securing a luffing jib crane, comprising the following steps:

- acquiring a jib lifting/lowering setpoint by means of a lifting speed command manipulator;

- piloting a lifting motor of a lifting winch by a converter that applies to said lifting motor a motor command speed as a function of the lifting/lowering setpoint;
- driving, in lifting or in lowering, the jib by at least one lifting cable of the lifting winch under the action of the lifting motor applying the motor command speed from the converter;
- acquiring, by a control/command system, the motor command speed or the lifting/lowering setpoint;
- calculating, by the control/command system, a jib lifting/lowering theoretical angular speed from the motor command speed or from the lifting/lowering setpoint;
- acquiring, by the control/command system, a jib angle measured by an angle sensor;
- calculating, by the control/command system, a jib lifting/lowering actual angular speed from the measured jib angle;
- comparing, by the control/command system, the jib lifting/lowering actual angular speed and the jib lifting/lowering theoretical angular speed; and
- commanding the stopping of the lifting motor, by the control/command system, according to the result from the comparison between the jib lifting/lowering actual angular speed and the jib lifting/lowering theoretical angular speed.

Thus, this securing method allows detecting automatically:

- the coherence of the jib lifting/lowering actual angular speed relative to the jib lifting/lowering theoretical angular speed which corresponds to the speed desired by the driver acting on the lifting speed command manipulator; and
- any incoherence between the jib lifting/lowering actual angular speed and the jib lifting/lowering theoretical angular speed, in order to protect the crane from the unwanted displacements of the jib which may lead to unwanted conditions for said crane.

This method therefore allows monitoring that the jib remains substantially immobile when the driver does not order a lifting or lowering movement, by means of an automatic coherence control between the command desired by the driver and the actual movement of the jib, which allows getting rid of the driver reaction. The detection of a risk of break or jolt in the movement of the jib is therefore more systematic and safer.

It also allows detecting unwanted jib displacements that may have several causes, such as a coupling or a speed reducer failure on the lifting winch, a jib collision causing a slowdown or a stop during movement, a blocking of the jib lifting cable, a blocking of pulleys located in the lifting cable path which would prevent unwinding too much lifting cable, in other words any (internal or external) disturbance that would occur in the kinematic chain, on the line of the lifting cable or that would act directly on the movement of the jib.

In a broader way, this method allows to impose a stopping of the lifting motor, and thus a stopping of the lifting or lowering movement, when the actual speed of the jib deviates from the speed desired by the driver by a predefined deviation, such as for example a gap in the order of 10%.

With such a method, by comparing the speed desired by the driver (namely the jib lifting/lowering theoretical angular speed) and the actual speed applied to the jib (namely the jib lifting/lowering actual angular speed), there is thus implemented a verification of the control/command, converter and kinematic chain set that goes beyond a simple monitoring on the lifting winch.

According to one feature, the control/command system emits a command for stopping the lifting motor when the difference between the jib lifting/lowering actual angular speed and the jib lifting/lowering theoretical angular speed is greater than a predefined threshold.

Such a threshold may be adapted to meet, for example, a safety-related standard or directive in the field of luffing jib cranes.

According to another feature, the control/command system emits a command for stopping the lifting motor when the difference between the jib lifting/lowering actual angular speed and the jib lifting/lowering theoretical angular speed is greater than a predefined threshold for a predefined time slot.

In a particular embodiment, the control/command system calculates the jib lifting/lowering theoretical angular speed from, on the one hand, the motor command speed or the lifting/lowering setpoint and, on the other hand, a jib lifting/lowering kinematic model.

According to one possibility of the invention, the jib lifting/lowering kinematic model is pre-established according to the structure and the dimensions of the jib and of the lifting winch.

Thus, the method can be implemented for different cranes, and in particular for different sizes of crane or different mechanisms in the lifting winch or different return mechanisms in the lifting cable, by adapting the kinematic model to each of the cranes.

According to another possibility of the invention, the method is implemented in a luffing jib tower crane.

The invention also relates to a luffing jib crane comprising:

- a lifting speed command manipulator allowing to acquire a jib lifting/lowering setpoint;
- a lifting winch incorporating a lifting motor and at least one lifting cable for driving, in lifting or in lowering, the jib;
- a converter piloting the lifting motor by applying to said lifting motor a motor command speed as a function of the lifting/lowering setpoint from the lifting speed command manipulator;
- an angle sensor allowing to measure a jib angle;
- a control/command system designed for:
  - acquiring the jib angle measured by the angle sensor;
  - calculating a jib lifting/lowering actual angular speed from the measured jib angle;
  - acquiring the motor command speed or the lifting/lowering setpoint;
  - calculating a jib lifting/lowering theoretical angular speed from the motor command speed or from the lifting/lowering setpoint;
  - comparing the jib lifting/lowering actual angular speed and the jib lifting/lowering theoretical angular speed; and
  - commanding the stopping of the lifting motor according to the result from the comparison between the jib lifting/lowering actual angular speed and the jib lifting/lowering theoretical angular speed.

Such a crane is thus shaped and designed for the implementation of the securing method as described above, with all the advantages already mentioned.

According to one possibility, the crane is a luffing jib tower crane.

The invention can also be envisaged with luffing jib cranes other than the luffing jib tower cranes, in particular with movable wheeled or crawler luffing jib cranes or luffing jib cranes on a maritime ship.

BRIEF DESCRIPTION OF THE DRAWINGS

Other features and advantages of the present invention will become apparent upon reading the detailed description below, of an example of non-limiting implementation, with reference to the appended figures in which.

DESCRIPTION

Figure 1:
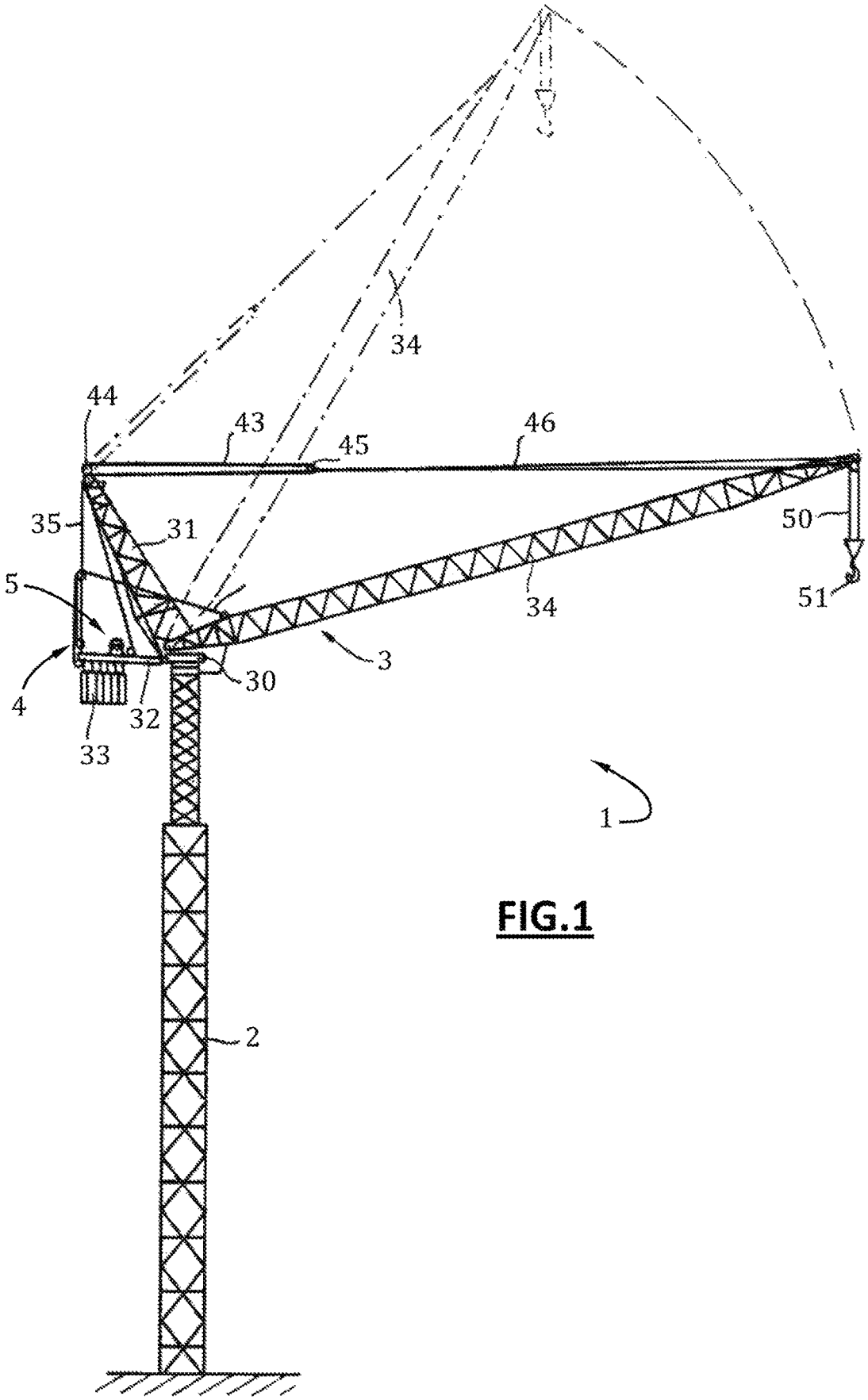
FIG. 1 is an overall lateral view of an example of a luffing jib crane adapted for the implementation of the invention, with indication of two positions of the luffing jib.

The luffing jib crane 1, shown in FIG. 1, is here a tower crane which comprises a vertical mast 2 anchored or movable on the ground and which is surmounted, by means of an orientation device, by a rotating part 3 comprising mainly a rotating pivot 30, a jib holder 31, a platform 32 (or counter-jib) on which a counterweight 33 is mounted, and a luffing jib 34.

The rotating pivot 30 is orientable about the vertical axis of the mast 2 and it supports a driver's cab (not illustrated in FIG. 1 and schematically shown in FIG. 2 under the reference 20) of the crane 1.

The jib holder 31, also known as a "punch", is secured to the rotating pivot 30 and extends from the latter upwards and obliquely with a backward inclination.

The platform 32 extends substantially horizontally rearwards, from the rotating pivot 30, and it carries in particular a lifting winch 4 described later, as well as the counterweight 33; this counterweight 33 can be mounted rolling under the platform 32. This platform 32 is suspended from the jib holder 31, in its rear part, by means of tie rods 35.

On the platform 32 are supported various equipment that comprise, especially, the lifting winch 4 for lifting/lowering the jib 34 and a hoisting winch 5 for hoisting loads suspended on the jib 34.

The luffing jib 34 is formed by a lattice structure, for example of triangular section, and has a hinged rear end, about a horizontal axis, on the rotating pivot 30.

The hoisting winch 5 has a drum on which is wound a hoisting cable 50, which passes over pulleys disposed on the jib holder 31, then is directed towards the tip of the luffing jib 34 and extends to a hosting hook 51, with or without reeving, the loads to be hoisted being suspended from the hook 51 when using the crane 1.

Figure 2:
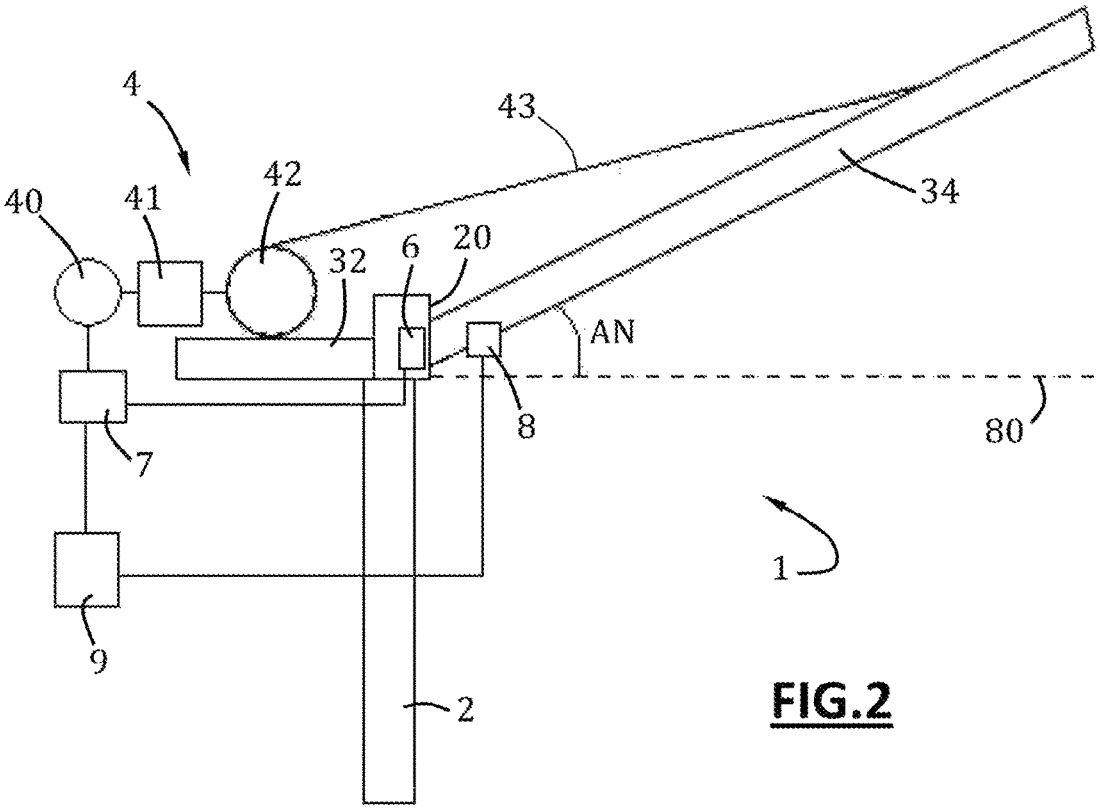
FIG. 2 is a schematic view of a luffing jib crane according to an embodiment of the invention.

With reference to FIGS. 1 and 2, the lifting winch 4 comprises a lifting motor 40 which drives in rotation, in both directions and via a reducer 41, a lifting drum 42, around which is wound a lifting cable 43 which passes over pulleys 44 disposed at the top of the jib holder 31, and which also passes on the pulleys of a lifting block 45, located in front of the jib holder 31. The lifting block 45 is in turn connected, by a line of tie rods 46, to the front part or "tip" of the luffing jib 34.

With reference to FIG. 2, the crane 1 comprises a lifting speed command manipulator 6 enabling the acquisition of a jib 34 lifting/lowering setpoint CO. This command manipulator 6 is placed in the driver's cab 20 and allows the crane driver to manually command the jib 34 lifting/lowering speed, its action on the command manipulator 6 resulting in a lifting/lowering setpoint CO.

The crane 1 also comprises a converter 7, of the frequency converter type, which pilots the lifting motor 40 by applying to the lifting motor 40 a motor command speed VCM as a function of the lifting/lowering setpoint CO from the lifting speed command manipulator 6.

The crane 1 also comprises an angle sensor 8 allowing to measure a jib angle AN, or an angle of the jib 34, with respect to a reference axis 80, this reference axis 80 can be for example the horizontal axis as shown schematically in FIG. 2.

The crane 1 further comprises a control/command system 9 connected to the angle sensor 8, to the command manipulator 6 and to the converter 7, where this control/command system 9 can be of the type electronic board, controller, processor, computer terminal or a combination of these units, and may be configured to execute program instructions stored in a computer-readable recording medium to perform one or steps according to the program instructions, such as those described with respect to the method or methods described herein.

The control/command system 9 is configured to:

acquire the jib angle AN measured by the angle sensor 8;

calculate a jib 34 lifting/lowering actual angular speed VRE from the measured jib angle AN;

acquire the motor command speed VCM or the lifting/lowering setpoint CO;

calculate a jib 34 lifting/lowering theoretical angular speed VTH from, on the one hand, the motor command speed VCM or the lifting/lowering setpoint CO and, on the other hand, a jib 34 lifting/lowering kinematic model MOD;

compare the jib 34 lifting/lowering actual angular speed VRE and the jib 34 lifting/lowering theoretical angular speed VTH;

command the stopping of the lifting motor 40 according to the result from the comparison between the jib 34 lifting/lowering actual angular speed VRE and the jib 34 lifting/lowering theoretical angular speed VTH.

More precisely, the control/command system 9 emits a command COM for stopping the lifting motor 40 when the difference DIF between the jib 34 lifting/lowering actual angular speed VRE and the jib 34 lifting/lowering theoretical angular speed VTH is greater than a predefined threshold SEU during a predefined time slot INT.

The jib lifting/lowering kinematic model MOD is pre-established according to the structure and dimensions of the jib 34 and of the lifting winch 4.

Figure 3:
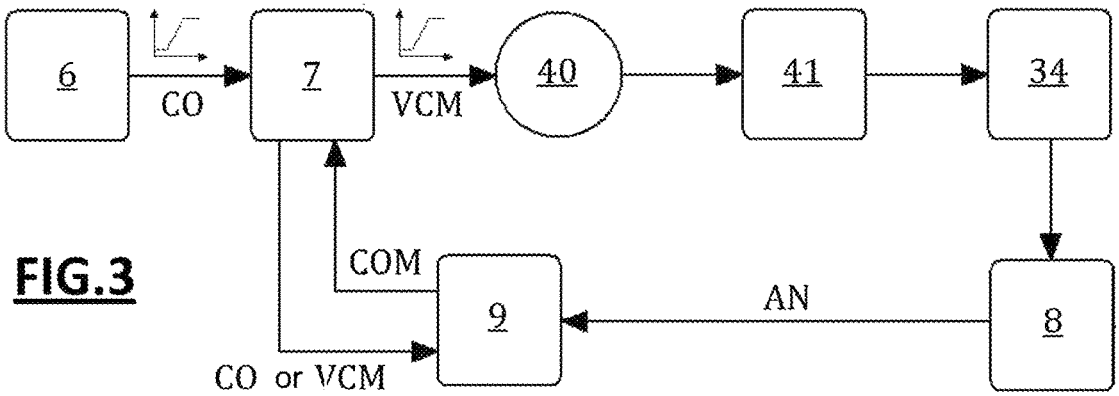
FIG. 3 is a schematic view of the main elements for the implementation of the method according to an embodiment of the invention.
Figure 4:
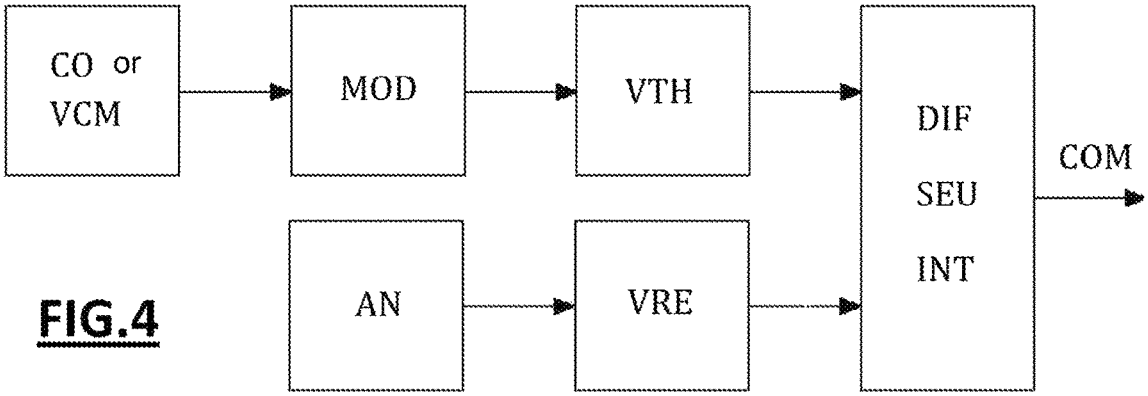
FIG. 4 is a schematic view of the calculations implemented by the control/command system during the securing method, according to an embodiment.

With reference to FIGS. 2 to 4, the securing method according to the invention therefore implements the following steps:

acquiring the jib lifting/lowering setpoint CO by means of a lifting speed command manipulator;

receiving, by the converter 7, the lifting/lowering setpoint CO;

piloting, by the converter 7, the lifting motor 40 by applying to the lifting motor 40 a motor command speed VCM as a function of the lifting/lowering setpoint CO;

driving, in lifting or in lowering, the jib 34 by the lifting cable 43 under the action of the lifting motor 40, via the reducer 41, by applying the motor command speed VCM from the converter 7;

acquiring, by the control/command system 9, the motor command speed VCM or the lifting/lowering setpoint CO;

calculating, by the control/command system 9, the jib 34 lifting/lowering theoretical angular speed VTH from, on the one hand, the motor command speed VCM or the lifting/lowering setpoint CO and, on the other hand, the jib 34 lifting/lowering kinematic model MOD;

acquiring, by the control/command system 9, the jib angle AN measured by the angle sensor 8;

calculating, by the control/command system 9, a jib 34 lifting/lowering actual angular speed VRE from the measured jib angle AN;

comparing, by the control/command system 9, the jib 34 lifting/lowering actual angular speed VRE and the jib 34 lifting/lowering theoretical angular speed VTH, by comparing as a reminder their difference DIF with the threshold SEU predefined over a predefined time slot INT;

sending a command COM for stopping the lifting motor 40 by the control/command system 9 according to the result from the comparison between the jib 34 lifting/lowering actual angular speed VRE and the jib 34 lifting/lowering theoretical angular speed VTH, this stop command COM can be addressed to the converter 7 which pilots the lifting motor 40 or directly to the lifting motor 40. Accordingly, the lifting motor 40 may be stopped in response to the command COM. That is, the command/control system 9 may control operation of the lifting motor 40 based on the comparison of the jib 34 lifting/lower actual angular speed VRE and the jib 34 lifting/lowering theoretical angular speed VTH, by sending the command COM for stopping the lifting motor 40.

Of course, the invention is not limited to the sole embodiment of this luffing jib 34 crane 1 which has been described above, by way of example and embraces, on the contrary, all the construction and application variants meeting the same principle. Especially, one would not depart from the scope of the invention:

by modifying or completing the lifting winch;

by modifying the path of the lifting cable;

by modifying the order of some steps of the securing method;

by intending the same securing method to lifting apparatuses other than luffing jib tower cranes, in particular to the wheeled or crawler movable cranes.

The methods according to the embodiments described herein may be performed, for example, by a computing device having a processor configured to execute program instructions stored in a computer-readable recording medium operably connected to the processor. In one embodiment, the processor and computer-readable recording medium may be the same as those described above with respect to the control/command system, or the computing device may be separate from control/command system 9, and operably and/or communicatively connected to various components of the luffing jib crane described above to perform the methods described herein. The computing device may be part of the luffing jib crane and disposed on the luffing jib, for example, at the driver's cab, distributed among different locations on the crane, positioned remote from the crane and operably and/or communicatively connected to the crane, or some combination thereof.

The invention claimed is:

1. A method for securing a lulling jib crane comprising the following steps:

acquiring a jib lifting/lowering setpoint (CO) with a lifting speed command manipulator;

piloting a lifting motor of a lifting winch by a converter that applies to said lifting motor a motor command speed (VCM) as a function of the lifting/lowering setpoint (CO);

driving, in lifting or in lowering, the jib by at least one lifting cable of the lifting winch under the action of the lifting motor applying the motor command speed (VCM) from the converter;

acquiring, by a control/command system, the motor command speed (VCM) or the lifting/lowering setpoint (CO);

calculating, by the control/command system, a jib lifting/lowering theoretical angular speed (VTH) from the motor command speed (VCM) or from the lifting/lowering setpoint (CO);

acquiring, by the control/command system, a jib angle (AN) measured by an angle sensor;

calculating, by the control/command system, a jib lifting/lowering actual angular speed (VRE) from the measured jib angle (AN);

comparing, by the control/command system, the jib lifting/lowering actual angular speed (VRE) and the jib lifting/lowering theoretical angular speed (VTH); and commanding the stopping (COM) of the lifting motor by the control/command system according to the result from the comparison between the jib lifting/lowering actual angular speed (VRE) and the jib lifting/lowering theoretical angular speed (VTH).

2. The securing method according to claim 1, wherein the control/command system emits the command for stopping (COM) the lifting motor when the difference between the jib lifting/lowering actual angular speed (VRE) and the jib lifting/lowering theoretical angular speed (VTH) is greater than a predefined threshold (SEU).

3. The securing method according to claim 2, wherein the control/command system emits the command for stopping (COM) the lifting motor when the difference between the jib lifting/lowering actual angular speed (VRE) and the jib lifting/lowering theoretical angular speed (VTH) is greater than a predefined threshold (SEU) during a predefined time slot (INT).

4. The securing method according to claim 1, wherein the control/command system further calculates the jib lifting/lowering theoretical angular speed (VTH) from a jib lifting/lowering kinematic model (MOD).

5. The securing method according to claim 4, wherein the jib lifting/lowering kinematic model (MOD) is pre-established according to the structure and dimensions of the jib and of the lifting winch.

6. The securing method according to claim 1, wherein the method is implemented in a luffing jib tower crane.

7. The securing method according to claim 1, wherein commanding the stopping (COM) of the lifting motor causes the lifting motor to stop.

8. A luffing jib crane having a luffing jib, comprising:

a lifting speed command manipulator allowing to acquire a jib lifting/lowering setpoint (CO);

a lifting winch incorporating a lifting motor and at least one lifting cable for driving, in lifting or in lowering, the luffing jib;

a converter piloting the lifting motor by applying to said lifting motor a motor command speed (VCM) as a function of the lifting/lowering setpoint (CO) from the lifting speed command manipulator;

an angle sensor allowing a measurement of a jib angle (AN);

a control/command system configured to:

acquire the jib angle (AN) measured by the angle sensor;

calculate a jib lifting/lowering actual angular speed (VRE) from the measured jib angle (AN);

acquire the motor command speed (VCM) or the lifting/lowering setpoint (CO);

calculate a jib lifting/lowering theoretical angular speed (VTH) from the motor command speed (VCM) or from the lifting/lowering setpoint (CO);

compare the jib lifting/lowering actual angular speed (VRE) and the jib lifting/lowering theoretical angular speed (VTH); and command the stopping of the lifting motor according to the result from the comparison between the jib lifting/lowering actual angular speed (VRE) and the jib lifting/lowering theoretical angular speed (VTH).

9. The luffing jib crane according to claim 8, wherein the crane is a luffing jib tower crane.

* * * * *